United States Patent [19]

Hurley

[11] 4,408,706

[45] Oct. 11, 1983

[54] HOLSTER FOR LABELER

[75] Inventor: Thomas M. Hurley, Miamisburg, Ohio

[73] Assignee: Monarch Marking Systems, Inc., Dayton, Ohio

[21] Appl. No.: 67,242

[22] Filed: Aug. 16, 1979

[51] Int. Cl.[3] ..... F41C 33/02

[52] U.S. Cl. ..... 224/192; 224/911; 224/904

[58] Field of Search ..... 224/191, 192, 193, 195, 224/253, 904, 911, 912, 914, 238, 198

[56] References Cited

U.S. PATENT DOCUMENTS

| | | | |
|---|---|---|---|
| 1,553,066 | 9/1925 | Burger | 224/242 |
| 1,844,603 | 2/1932 | Sarson | 224/238 |
| 2,037,132 | 4/1936 | Hoyt | 224/206 |
| 2,531,170 | 11/1950 | Tackett | 224/198 |
| 2,819,830 | 1/1958 | Murray | 224/253 X |
| 2,926,403 | 3/1960 | Weissman | 24/3 |
| 3,004,315 | 10/1961 | Masure | 24/3 |
| 3,294,298 | 12/1966 | Danielson | 224/252 |
| 3,347,299 | 10/1967 | Alexander | 150/34 |
| 3,445,046 | 5/1969 | Wilson | 224/148 |
| 3,688,953 | 9/1972 | Bianchi | 224/192 |

FOREIGN PATENT DOCUMENTS 354464 9/1931 United Kingdom .

*Primary Examiner*—Steven M. Pollard
*Attorney, Agent, or Firm*—Joseph J. Grass

[57] ABSTRACT

There is disclosed a holster adapted to hold a gun-like labeler. The holster is adapted to be connected to a belt of a user and to be worn in either the left-hand or right-hand position. The holster preferably includes a plurality of holster members with one of the holster members being adapted to carry a labeler and other holster members being adapted to carry a label roll, a utility knife, and the like.

13 Claims, 5 Drawing Figures

HOLSTER FOR LABELER

BACKGROUND OF THE INVENTION

1. Field of the Invention

This invention relates to holsters for labelers.

2. Brief Description of the Prior Art

The prior art contains various U.S. patents relating to holsters, U.S. Pat. No. 1,553,066 to Burger issued Sept. 8, 1925, U.S. Pat. No. 1,844,603 to Sarson issued Feb. 9, 1932, U.S. Pat. No. 2,037,132 to Hoyt issued Apr. 14, 1936, U.S. Pat. No. 2,926,403 to Weissman issued Mar. 1, 1960, U.S. Pat. No. 3,004,315 to Masure issued Oct. 17, 1961, U.S. Pat. No. 3,294,298 to Danielson issued Dec. 27, 1966, U.S. Pat. No. 3,347,299 to Alexander issued Oct. 17, 1967, U.S. Pat. No. 3,445,046 to Wilson issued May 20, 1969, U.S. Pat. No. 3,688,953 to Blanchi issued Sept. 5, 1972, and British Pat. No. 354,464 to Lampney et al accepted Aug. 13, 1931.

SUMMARY OF THE INVENTION

This invention relates to a holster for a gun-type labeler which is also adapted to carry labels, tools and other types of supplies useful in labeling. In accordance with a specific embodiment there is disclosed a holster adapted to be connected to a belt of a user. The holster includes a holder having a fastener of a first type, and a holster member for receiving a labeler in one orientation. The holster member includes spaced sides between which the labeler is positioned. Each side of the holster member includes a fastener of a second type. A fastener of the first type can be releasably connected with a fastener of the second type. The second type fastener on either side of the holster member is connectable to the first type fastener on the holder so that the labeler can be carried by the user in either the left-hand or the right-hand position. It is preferred that a second holster member have a fastener of the first type detachably connectable to the remaining fasteners of the second type of the first holster member. There can be various second holster members that can alternately be connected to the first holster member. The second holster members have different structures to accommodate different types of articles, such as labelers, utility knives, etc.

DETAILED DESCRIPTION OF THE PREFERRED EMBODIMENTS

Figures 1, 2, 3, 4, 5:
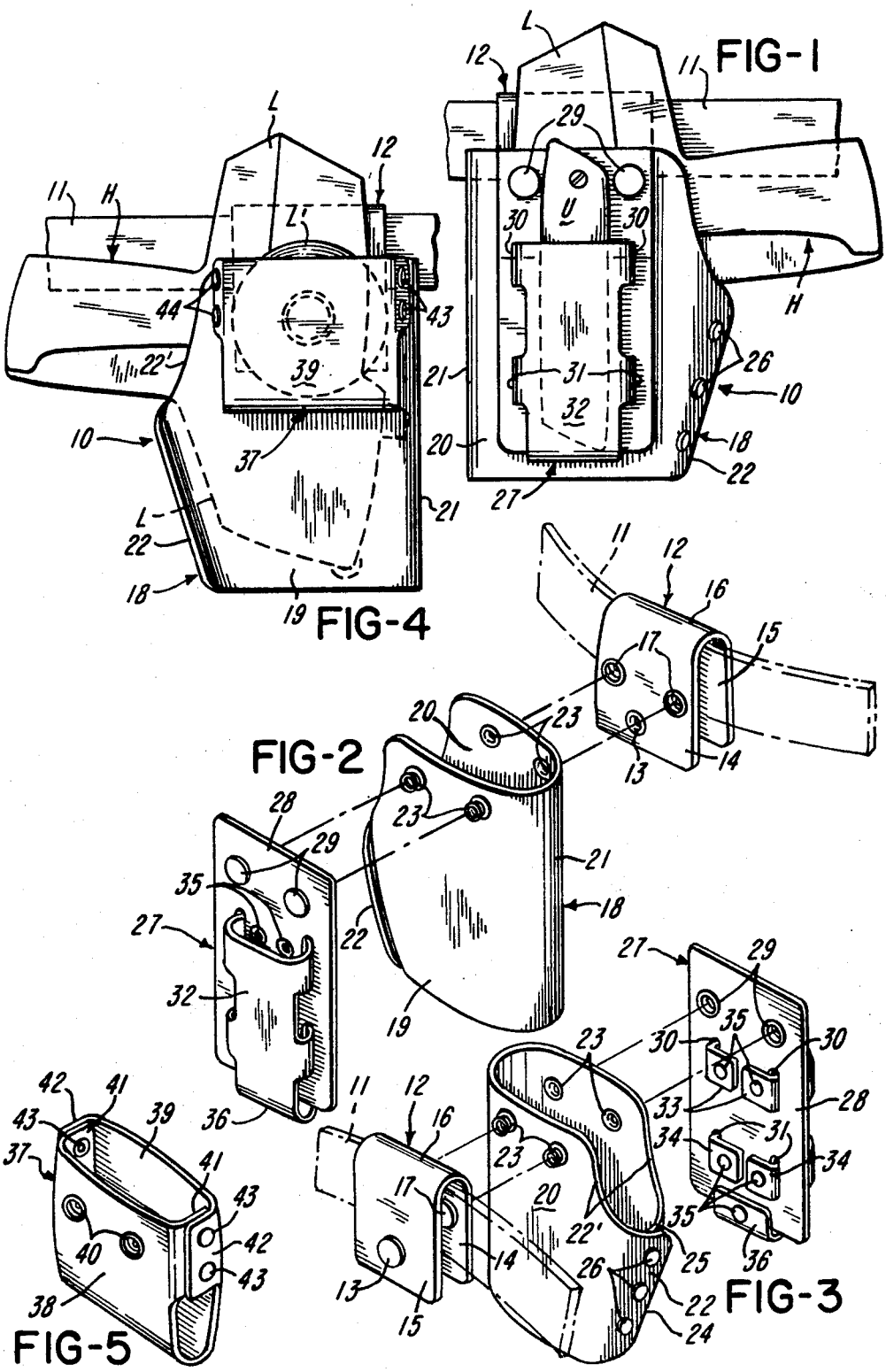
FIG. 1 is a side elevational view of a holster shown connected to a belt.
FIG. 2 is a partially exploded perspective view of the holster shown in FIG. 1.
FIG. 3 is a partially exploded perspective view showing the other side of the holster from that shown in FIG. 2.
FIG. 4 is a side elevational view of a holster in accordance with an alternative embodiment of the invention.
FIG. 5 is a perspective view of a holster member shown in FIG. 4.

Referring to the embodiment of FIGS. 1 through 3, there is shown a holster generally indicated at 10 which is adapted to be connected to a belt 11 of a user. The holster 10 includes a holder 12 which is detachably connected to the belt 11 by a fastener 13 which is preferably of the snap-type so that the holder 12 can be attached and detached from the belt 11. The holder 12 has a generally U-shaped configuration and includes legs 14 and 15. The snap fasteners 13 connect the legs 14 and 15 at a considerable distance from the bight 16. More specifically, the holder is oriented like an inverted U and the fastener 13 is connected to the lower end portions of the legs 14 and 15. Fasteners 16 and 17 are of a first type. Specifically the fasteners 16 and 17 are female portions which are adapted to receive mating male portions.

A holster member 18 adapted to receive a hand-held labeler L is shown to have a pair of spaced sides or side portions 19 and 20 and ends or end portions 21 and 22. The sides 19 and 20 have fasteners 23 of a second type which in the illustrated embodiment are male portions which make a snap fit with the female portions of fasteners 16. The holder 12 is shown to have two horizontally arranged fasteners 16 and each side 19 and 20 of the holster member 18 has two horizontally arranged fasteners 23 with the same horizontal spacing as the fasteners 16. It is apparent that the fasteners 23 on the side 20 can be snap-fitted onto the fasteners 16. It is apparent that the fasteners 23 on the side 20 can be snap fitted onto the fasteners 16. Alternatively, the fasteners 23 on the side 19 can be snap fitted with the fasteners 16. The holder 12 and the holster member 18 are made from one piece of sheet material. Terminal end portions 24 and 25 of the holster member 18 are overlapped to provide a lap joint when connected by fasteners 26. The lap joint is advantageous because of this construction the pocket formed by the holster member 18 is held open. The fasteners 26 are preferably of the permanent type such as rivets. The end portion 22 is cut out at the top portion as indicated at 22' to provide an opening to receive handle H of the labeler L. The other end portion 21 does not have such an opening so the labeler L can be received in the holster member 18 in only one orientation.

Another holster member 27 is shown to include a one-piece panel 28 having fasteners 29 of the first type which in the illustration are female portions. The fasteners 29 are horizontally arranged and have the same spacing as the pair of fasteners 16 and the pair of fasteners 23 on the side 19, and the pair of fasteners on the side 20. In the illustration, the fasteners 29 are connected to the fasteners 23 on the side 19. In the event the position of the holster member 13 is reversed, the fasteners 29 can be connected to the fasteners 23 on the side 20. Disposed below the level of the fasteners 29 are two vertically spaced sets of openings or cutouts 30 and 31. Another one-piece panel 32 is shown to have vertically spaced tabs 33 and 34 which extend through respective openings 30 and 31 and are folded over and attached to the underside of the panel 28 by fasteners preferably of the permanent type such as rivets 35. The lower end portion of the panel 32 has a tab 36 bent into a U-shaped orientation and attached as for example by a rivet 35 to the underside of the panel 28.

The embodiment of FIGS. 4 and 5 is the same as the embodiment of FIGS. 1 through 3 except that a different holster member 37 is provided so that alternately the holster member 27 or the holster member 37 can be connected to the holster member 18. Accordingly, except for the holster member 37, the same reference characters used in the embodiment of FIGS. 4 and 5 as in the embodiment of FIGS. 1 through 3. The holster member 37 is constructed from one flexible sheet or panel bent into a U-shaped configuration as shown in FIG. 5. The holster member 37 is adapted to receive a roll of labels L' or the like. The holster member has a pair of sides or side portions 38 and 39. Fasteners 40 are of the second type specifically female portions and are connected to the side 38. Fasteners 40 are horizontally arranged and spaced to be detachably connected to either the fasteners 23 of the panel 19 or the fasteners 23 on the panel 20. The holster member 37 has end tabs 41 joined to the side 48 and end tabs 42 joined to the side 49. The tabs are overlapped and are united at a lap joint, being connected by fasteners 43 which are preferably of the permanent type such as rivets. The lap joints tend to hold the label roll receiving packet open so that the label roll L' can be readily inserted and removed.

It is preferred to use pairs of fasteners 16, pairs of fasteners 23 and pairs of fasteners 29 so that the holster members 18 and 27 will not swing relative to the holder 12. Also, the preferred embodiment utilizes male and female snap fasteners although other types of fasteners might be used.

Other embodiments and modifications of this invention will suggest themselves to those skilled in the art, and all such of these as come within the spirit of this invention are included within its scope as best defined by the appended claims.

I claim:

1. A holster adapted to hold a gun-like labeler, comprising: a generally U-shaped holder adapted to fit over a belt of a user, a snap fastener for connecting opposed legs of the holder, one leg of the holder having a first snap fastener portion, a first holster member comprised of a one-piece panel having end portions connected by a lap joint and opposed side portions, each side portion having a second snap fastener portion so that either side of the first holster member can be detachably connected to the holder, a second generally U-shaped holster member adapted to carry a roll of labels, the second holster member comprised of a one-piece panel having opposed sides and overlapped, connected, end tabs, one side of the second holster member having a first snap fastener portion for connection of the remaining second snap fastener portion on the first holster member.

2. A holster adapted to hold a gun-like labeler, comprising: a generally U-shaped holder adapted to fit over a belt of a user, a snap fastener for connecting opposed legs of the holder, one leg of the holder having a first snap fastener portion, a first holster member comprised of a one-piece panel having end portions connected by a lap joint and opposed side portions, each side portion having a second snap fastener portion so that either side of the first holster member can be detachably connected to the holder, a second holster member adapted to carry a tool, the second holster member comprised of a first one-piece panel having a first snap fastener portion for connection to the remaining second snap fastener portion on the first holster member, the second holster member having a second one-piece panel having two sets of lateral tabs and a bottom tab, the first panel having two sets of apertures through which the lateral tabs extend, and means for connecting the lateral tabs and the bottom tab to the underside of the first panel.

3. A holster adapted to hold a gun-like labeler, comprising: a generally U-shaped holder adapted to fit over a belt of a user, a snap fastener for connecting opposed legs of the holder, one leg of the holder having a first snap fastener portion, a first holster member comprised of a one-piece panel having end portions connected by a lap joint and opposed side portions, each side portion having a second snap fastener portion so that either side of the first holster member can be detachably connected to the holder, and either one of the following:

A. a second holster member adapted to carry a roll of labels, the second generally U-shaped holster member comprised of a one-piece panel having opposed sides and overlapped, connected, end tabs, one side of the second holster member having a first snap fastener portion for connection of the remaining second snap fastener portion on the first holster member; and, B. a second holster member adapted to carry a tool, the second holster member comprised of a first one-piece panel having a first snap fastener portion for connection to the remaining second snap fastener portion on the first holster member, the second holster member having a second one-piece panel having two sets of lateral tabs and a bottom tab, the first panel having two sets of apertures through which the lateral tabs extend, means for connecting the lateral tabs and the bottom tab to the underside of the first panel, the first snap fastener portions of the second holster members according to either A. or B. above being identical.

4. A holster as defined in claim 3, wherein the holder has two first snap fastener portions, the first holster member has two second snap fastener portions and both of the second holster members have two first snap fastener portions.

5. A holster adapted to hold a gun-like lableler, comprising: a holder adapted to be connected to a belt of a user, a first holster member detachably connected to the holder and adapted to receive a labeler, a second holster member, means for detachably connecting the first and second holster members, a third holster member, means for detachably connecting the first and second holster members, and means for detachably connecting the first and third holster members, the means for connecting the first and second holster members and the means for connecting the first and third holster members having structure common to both so that either the second holster member or the third holster member can alternately be attached to the first holster member.

6. A holster, comprising: a holder adapted to be connected to a belt of a user, a first holster member having an opening adapted to receive a labeler gun in only one orientation and having a pair of side portions, a second holster member adapted to receive a roll of labels, the holder having a fastener portion of a first type, each side portion of the first holster member having an outwardly cooperating fastener portion of a second type providing for connection of the first type fastener portion of the holder to the second type fastener portion on either of the side portions of the first holster member so that the labeler gun can be carried by the user in either the left-hand or the right-hand position, and the second holster member having a fastener portion of the first type for connection to the second type fastener portion on the remaining side portion of the first holster member.

7. A holster as defined in claim 6, wherein the first and second fastener portions comprising mating parts of snap fasteners.

8. A holster as defined in claim 6, wherein the fastener portions of the first type mate with fastener portions of the second type.

9. A holster, comprising: a holder adapted to be connected to a belt of user, a first holster member having an opening adapted to receive a labeler gun in only one orientation and having a pair of side portions, a second holster member adapted to receive a roll of labels, the holder having a pair of fastener portions of a first type, each side portion of the first holster member having a pair of outwardly cooperating fastener portions of a second type providing for connection of the first type fastener portions of the holder to the pair of second type fastener portions on either of the side portions of the first holster member so that the labeler gun can be carried by the user in either the left-hand or the right-hand position, and the second holster member having a pair of fastener portions of the first type for connection to the pair of second type fastener portions on the remaining side portion of the first holster member.

10. A holster as defined in claim 9, wherein the first and second fastener portions comprise mating parts of snap fasteners.

11. A holster as defined in claim 9, wherein the fastener portions of the first type mate with fastener portions of the second type.

12. A holster adapted to hold a gun-like labeler, comprising: a holder adapted to be connected to a belt of a user, the holder having a fastener of a first type, a first holster member for receiving a labeler in one orientation, the first holster member including spaced sides between which the labeler is positioned, each side including a fastener of a second type, a said fastener of the first type releasably connecting with a said fastener of the second type, the second type fastener on either side of the first holster member being connectable to the first type fastener on the holder so that the labeler will be carried by the user in either the left hand or right hand position, wherein there is a second holster member having a fastener of the first type detachably connectable to the remaining fastener of the second type of the first holster member, wherein the second holster member is comprised of a first panel having the first type fastener and a second panel, and the first panel having apertures and the second panel having tabs extending through the apertures and attached to the underside of the first panel.

13. A holster as defined in claim 12, wherein the second holster member has a tab extending under the bottom of the first panel and attached to the underside of the first panel.

* * * * *

UNITED STATES PATENT AND TRADEMARK OFFICE

CERTIFICATE OF CORRECTION

PATENT NO. : 4,408,706

DATED : October 11, 1983

INVENTOR(S) : Thomas M. Hurley

It is certified that error appears in the above-identified patent and that said Letters Patent are hereby corrected as shown below:

Column 2, line 29, "of" should be --by--.

Column 4, line 35, "means" should be deleted;

line 36, "for detachably connecting the first and second holster" should be deleted;

line 37, "members" should be deleted;

line 63, "comprising" should be --comprise--.

Signed and Sealed this

*Seventh* Day of *February 1984*

[SEAL]

*Attest:*

GERALD J. MOSSINGHOFF

*Attesting Officer*

*Commissioner of Patents and Trademarks*